US010850369B2

(12) United States Patent
Eklund

(10) Patent No.: US 10,850,369 B2
(45) Date of Patent: Dec. 1, 2020

(54) GRINDER/POLISHER APPARATUS AND A GRINDING ELEMENT THEREFOR

(71) Applicant: Tore Eklund, Motala (SE)

(72) Inventor: Tore Eklund, Motala (SE)

( * ) Notice: Subject to any disclaimer, the term of this patent is extended or adjusted under 35 U.S.C. 154(b) by 241 days.

(21) Appl. No.: 15/580,547

(22) PCT Filed: May 20, 2016

(86) PCT No.: PCT/SE2016/050470
§ 371 (c)(1),
(2) Date: Dec. 7, 2017

(87) PCT Pub. No.: WO2016/186567
PCT Pub. Date: Nov. 24, 2016

(65) Prior Publication Data

US 2018/0178352 A1 Jun. 28, 2018

(30) Foreign Application Priority Data

May 21, 2015 (SE) ..... 1550652

(51) Int. Cl.
*B24B 3/54* (2006.01)
*B24D 15/06* (2006.01)
*B24D 15/08* (2006.01)

(52) U.S. Cl.
CPC ..... *B24D 15/081* (2013.01); *B24B 3/54* (2013.01); *B24D 15/06* (2013.01); *B24D 15/065* (2013.01); *B24D 15/08* (2013.01)

(58) Field of Classification Search
CPC ..... B24D 15/06; B24D 15/065; B24D 15/08; B24D 15/081; B24B 3/54
USPC ..... 451/261, 262, 267, 293
See application file for complete search history.

(56) References Cited

U.S. PATENT DOCUMENTS

| | | | | |
|---|---|---|---|---|
| 1,909,743 | A * | 5/1933 | Blankner | B24D 15/081 451/486 |
| 4,624,079 | A | 11/1986 | Bonapace | |
| 6,168,509 | B1 | 1/2001 | Presgrove | |
| 8,944,894 | B2 * | 2/2015 | Smith | B24D 15/081 451/196 |
| 10,272,535 | B1 * | 4/2019 | Lyons | B24B 49/04 |
| 2007/0281590 | A1 * | 12/2007 | Friel, Sr. | B24D 15/08 451/45 |
| 2008/0041190 | A1 | 2/2008 | Dassaud et al. | |
| 2009/0181602 | A1 * | 7/2009 | Friel, Sr. | B24D 15/08 451/234 |
| 2013/0065494 | A1 | 3/2013 | Wu | |

(Continued)

FOREIGN PATENT DOCUMENTS

| | | | |
|---|---|---|---|
| WO | 2009/134193 | A1 | 11/2009 |
| WO | 2015/030655 | A1 | 5/2015 |

*Primary Examiner* — Eileen P Morgan
(74) *Attorney, Agent, or Firm* — Dilworth & Barrese, LLP

(57) ABSTRACT

A grinder/polisher apparatus is disclosed, the apparatus comprising first and second sets of grinding elements (2, 3) facing each other under an angle (α) thus forming between the sets of grinding elements a V-groove in which the cutting edge of a knife is insertable for movement upon grinding, wherein the grinding elements are supported in holders (5, 6). The grinding elements (2, 3) are pivotally arranged in the holders (5, 6) about axes (R, R') the inclinations of which correspond with the opening angle (α) of the V-groove.

8 Claims, 2 Drawing Sheets

(56) References Cited

U.S. PATENT DOCUMENTS

Figure 1:
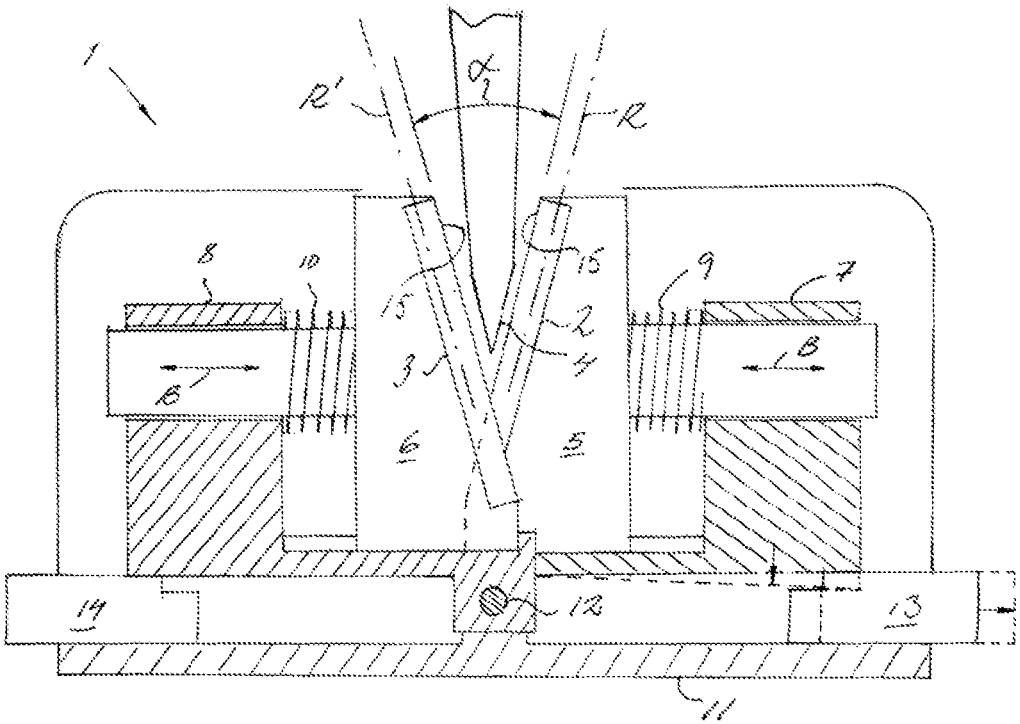

| | | | | |
|---|---|---|---|---|
| 2013/0267153 | A1* | 10/2013 | Zahnd | B24B 3/54 451/282 |
| 2014/0120812 | A1* | 5/2014 | Smith | B24D 15/081 451/552 |
| 2016/0368116 | A1* | 12/2016 | Wu | B24D 15/081 |

* cited by examiner

GRINDER/POLISHER APPARATUS AND A GRINDING ELEMENT THEREFOR

TECHNICAL FIELD OF THE INVENTION

The present invention relates to a grinder apparatus of the type which comprises first and second sets of grinding elements facing each other under an angle, thus forming between the sets of grinding elements a V-groove in which the cutting edge of a knife is insertable for movement upon grinding, wherein the grinding elements are supported in holders. The invention further relates to the grinding element per se, which can be embodied with coarse or fine abrasive for grinding or polishing treatment of a knife edge.

BACKGROUND AND PRIOR ART

A similar grinder or polisher apparatus is previously known from WO 2015/030655, disclosing opposite sets of spaced apart grinding elements which engage in an overlapping relation to form a V-groove for insertion of the knife. The grinding elements are individually supported in holders and biased towards the center of the V-groove by separate springs. The V-groove this way adapts its depth to the orientation of the knife and a good result is achieved even if the knife is not moved strictly horizontally as seen in a vertical view.

Even though the grinder of WO 2015/030655 has some ability to adapt the V-groove to a knife which is not moved in an ideal straight path in the V-groove as seen in a horizontal view, the active area of contact between the knife and the grinding elements will be restricted to a limited region of the grinding elements if the knife is moved in a path that is non-parallel with the front faces of the grinding elements. This may lead to local wear-down of the grinding elements and reduced efficiency in the grinding or polishing treatment of the knife.

SUMMARY OF THE INVENTION

The present invention aims to provide an improved grinder/polisher apparatus for treating the cutting edge of a knife, which avoids the drawbacks and problems related to a non-straight orientation or non-linear motion of the knife in the V-groove, in the horizontal view.

The object is met in a grinder/polisher apparatus as described initially, wherein the grinding elements are pivotally arranged in the holders about axes the inclinations of which correspond with the opening angle of the V-groove.

As used herein, the expression "the inclinations of which correspond with the opening angle of the V-groove" is aimed to specify the orientation of the pivot axes in relation to the grinding elements and the V-groove.

Obviously, the V-groove is defined by the abrasive front faces in the sets of grinding elements, the front faces forming the sloping sides of the V-groove. In preferred embodiments of the invention, the grinding elements are pivotally arranged in a forward end of the holders (i.e. the end facing the V-groove) about axes that are parallel or nearly parallel to the front faces of the grinding elements. In other words, the pivot axes may be parallel or nearly parallel to the sides of the V-groove. Thus, if the inclinations of the pivot axes are changed it will affect the opening angle of the V-groove. The opening angle of the V-groove may be adjustable to adapt the grinder apparatus for treatment of differently angled knife cutting edges, whereby change of the V-groove angle can be accomplished by changing the position of the holders in the apparatus, this way changing the inclinations of the pivot axes and of the grinding elements accordingly.

However, a perfect alignment between the pivot axes and the front faces of the grinding elements may not always be critical and hence the relation can be defined as parallel or nearly parallel. The expression "correspond with" shall be understood to include embodiments wherein the pivot axes are parallel or nearly parallel with the sloping V-groove sides which are defined by the front faces of the grinding elements.

In embodiments of the invention the grinding element has a grinding or polishing front face and a rear face comprising coupling means by which the grinding element is pivotally hinged to the holder. This embodiment is advantageously applied to press-shaped grinding elements.

The above mentioned coupling means may be realized in the form of a ridge having a part-circular sectional profile that runs in the length direction of the grinding element, the ridge pivotally received in a corresponding profile of a groove formed in the forward end of the holder.

In this embodiment at least one of the rear face of the grinding element and the forward end of the holder can be formed with surfaces which are sloping at an obtuse angle from the ridge or from the groove respectively.

Another embodiment of the invention comprises a grinding element having a grinding or polishing front face and a rear face riding on a curved or partially circular forward end of the holder. This embodiment is advantageously applied to grinding elements formed from abrasive coated plate members.

In this latter embodiment the longitudinal sides of the grinding element are formed with a lug respectively which movably engages a recess formed in each side flank that adjoins the forward end of the holder, wherein the lug and recess in mutual engagement control a sideways tilting movement of the grinding element with respect to the holder. The lug and recess may be extended the length of the grinding element.

In the apparatus, preferably, the grinding elements of the first or second sets of grinding elements are individually biased by separate springs towards the other set of grinding elements.

In analogy with the aforesaid the present invention further relates to a grinding element for a grinder/polisher apparatus that comprises first and second sets of grinding elements facing each other under an angle thus forming between the front faces of grinding elements a V-groove in which the cutting edge of a knife is insertable for movement upon grinding, wherein the grinding element is supported in a holder.

In accordance with this second aspect of the present invention, the grinding element is characterized by being pivotally arranged in the holder about an axis the inclination of which corresponds with the inclination of the front face of the grinding element.

In one embodiment the grinding element is realized in the form of a press-shaped body having a planar or substantially planar front face, two sides connecting the front face with a rear face, and including a ridge having a part-circular sectional profile that protrudes above the rear face and runs along the longitudinal center of the rear face. In this embodiment the rear face is advantageously formed with two opposite surfaces which are sloping at an obtuse intermediate angle from the ridge towards the sides of the press-shaped body.

In another embodiment the grinding element is realized in the form of a plate member having a planar or substantially planar and abrasive coated front face, the longitudinal sides of the plate member swept back and inwards to produce engagement lugs extended the length of the plate member.

SHORT DESCRIPTION OF THE DRAWINGS

Figure 2:
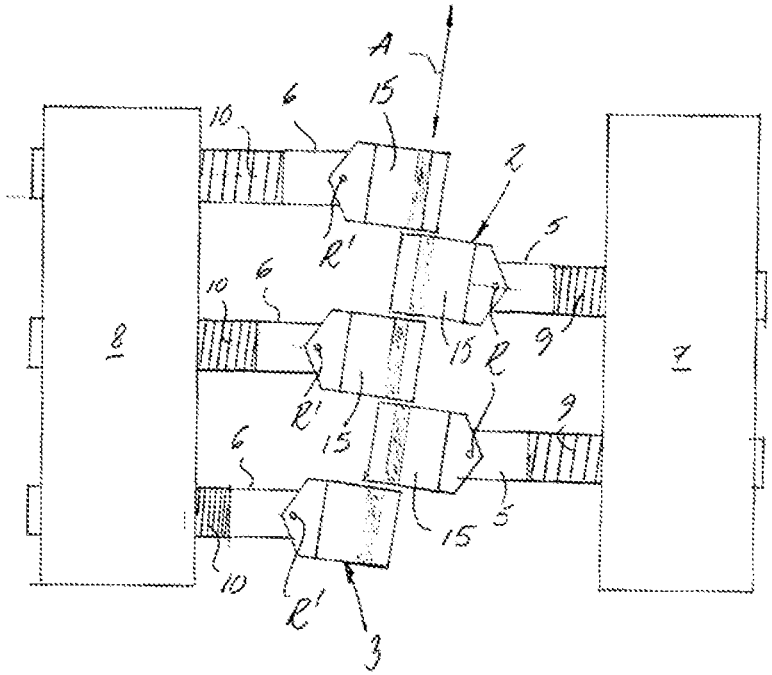
Figure 3:
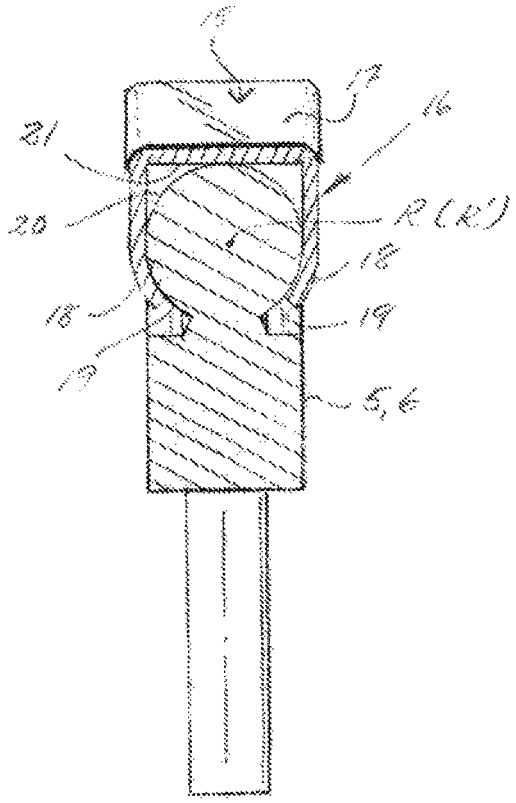
Figure 4:
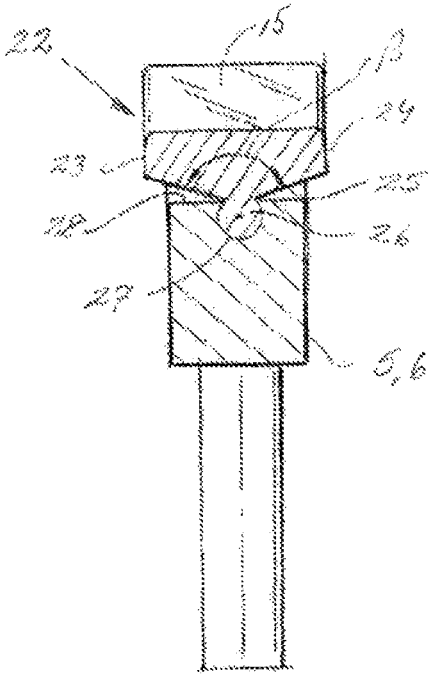

Further details and advantages of the invention will be explained below with reference made to the accompanying schematic drawings. In the drawings, FIG. 1 is a partially broken away side view of a grinder/polisher apparatus to which the present invention can be applied, FIG. 2 is a view from above showing the grinding elements pivotally adjusted to the non-straight orientation of a knife to be treated, FIG. 3 is a cross-sectional view through a grinding element pivotally supported in a holder according to one embodiment of the invention, and FIG. 4 is a corresponding cross-sectional view through a grinding element pivotally hinged to a holder according to another embodiment of the invention.

DETAILED DESCRIPTION OF PREFERRED EMBODIMENTS

The grinder or polisher apparatus 1 of FIG. 1 comprises first and second sets of grinding or polishing elements 2 and 3 facing each other under an angle α, thus forming between the sets of grinding elements a V-groove in which the cutting edge 4 of a knife is insertable for grinding in a back and forwards movement as seen in the horizontal view. The movement of the knife in the horizontal view is indicated through an arrow A in FIG. 2.

The grinding elements 2, 3 are supported in holders 5 and 6. The holders 5, 6 are journalled in blocks 7, 8 and movable in opposite directions as indicated through the arrows B. Springs 9 and 10 apply a biasing force to the holders and grinding elements towards the V-groove. The blocks 7, 8, the holders 5, 6 and the grinding elements 2, 3 are mounted on a base 11.

In this connection it shall be noted that the movement of the knife during grinding, thanks to the spring-biased mounting of the grinding elements, can be composed of both horizontal and vertical components of directions, such that the knife describes an oscillating motion when seen in a vertical view.

The grinder apparatus 1 may be arranged for adjustment of the opening angle α, if appropriate. To this purpose the grinding elements, holders and blocks may be journalled on a pivot 12 and associated with wedges 13 and 14 that control the angular position and intermediate angle α between the first and second sets of grinding elements.

The grinding elements 2, 3 are pivotally supported in the respective holders 5 and 6. More precisely, the grinding elements are arranged for pivoting movement about axes R and R' which follow the directions of the front faces 15 of the subject grinding elements. In other words, the pivot axes R, R' follow the directions of the sloping sides of the V-groove, which are defined respectively through the front faces of the grinding elements in the subject set of grinding elements.

The pivotal mounting of the grinding elements in the holders permit the grinding apparatus to adapt to a knife which is not rectilinearly inserted in the V-groove. As illustrated in FIG. 2, the pivotally supported grinding elements adjust their position with respect to the knife's orientation such that full contact with the active abrasive portions of the grinding elements, in FIG. 2 indicated through shadowed areas in the front faces 15, can be achieved throughout the grinding procedure.

The invention can be realized in several embodiments.

In one embodiment shown in FIG. 3 the grinding element comprises a plate member 16 with an abrasive coating 17 applied to its substantially planar front face. The plate member 16 is an elongate element, wherein the longitudinal sides are swept back and inwards to produce engagement lugs 18 which may be extended the whole length of the grinding element. The lugs 18 are movably received in recesses 19 which are formed in the opposite sides that adjoin the forward end 20 of the holder. The lugs 18 and recesses 19 in mutual engagement limit a sideways tilting movement of the grinding element, which rests with its rear face 21 against the curved forward end of the holder. The lugs 18, recesses 19 and the forward end 20 of the holder may be circular in shape as illustrated to permit the grinding element a pivoting movement about the pivot axis R (R') with respect to the holder. The embodiment of FIG. 3 may comprise a metal plate coated with an abrasive material, or a shaped plastic plate which is metallized and then coated with an abrasive material, such as diamond e.g.

In another embodiment shown in FIG. 4 the grinding element is a press-shaped body 22 having a planar or substantially planar front, two sides 23 and 24 connecting the front face with a rear face 25. A ridge 26 which partially has a circular sectional profile protrudes above the rear face and runs centrally along the rear face 25. The ridge 26 is pivotally received in a groove 27 of corresponding sectional profile, the groove 27 opening towards the body in the forward end 28 of the holder. In mutual engagement, the ridge 26 and the groove 27 provide a coupling means 26, 27 through which the body is hinged to the holder for pivoting movement about the pivot axis R (R'). At least one of the rear face 25 and the forward end 28 of the holder comprises surfaces which are sloping from the ridge or groove respectively, at an obtuse angle β, in order to permit a sideways tilting movement of the grinding element relative to the holder. The embodiment of FIG. 4 may comprise a press-shaped ceramic or powder-metallic body, e.g.

The individually pivoting grinding elements of the present invention, as well as the individually spring biased grinding elements of prior art, are each examples of advantageous improvements in grinder/polisher apparatuses intended for the treatment of a knife's cutting edge. Simultaneously applied these features provide a combination which is extremely forgiving in respect of the orientation of the knife during grinding.

The invention claimed is:

1. A sharpening apparatus comprising a first set of grinding elements (2) and a second set of grinding elements (3), said first set of grinding elements (2) comprising a plurality of grinding elements (2) and said second set of grinding elements (3) comprising a plurality of grinding elements (3), said grinding elements (2) of said first set of grinding elements (2) and said grinding elements (3) of said second set of grinding elements (3) alternately arranged in overlapping relation to one another along an axial direction, said grinding elements (2) of said first set of grinding elements (2) and said grinding elements (3) of said second set of grinding elements (3) each comprising a front face (15), said first set of grinding elements (2) and said second set of grinding elements (3) being mounted upon a base (11), said front faces (15) of each of said grinding elements (2, 3) of said first (2) and second (3) sets of grinding elements each angled with respect to the base (11) to define a V-groove therebetween when viewed along the axial direction between said front faces (15) of the grinding elements (2, 3) of said first (2) and second (3) sets of grinding elements, said V-shaped groove having an angle (α) defined between the front faces (15) of said grinding elements (2, 3) of said first set (2) of grinding elements and said second set (3) of grinding elements, when viewed along the axial direction between said front faces (15), wherein the grinding elements (2) of said first set of grinding elements (2) are each individually supported in a holder (5) and said grinding elements (3) of said second set of grinding elements (3) are each individually supported in a holder (6), with said holders (5) in said first set of grinding elements (2) being movable in opposite directions (B) from the grinding elements (3) in said second set of grinding elements (3), and said holders (6) in said second set of grinding elements (3) being movable in opposite directions (B) from the grinding elements (2) in the first set of grinding elements (2), springs (9, 10) are arranged to bias each of the holders (5, 6) in the direction towards the opposite set of grinding elements, the grinding elements (2) of said first set of grinding elements (2) and said grinding elements (3) of said second set of grinding elements (3) each having a rear face (25) on a side opposite said front face (15), said rear faces (25) of all said grinding elements each comprising coupling means (26, 27) by which the grinding elements (2,3) of said first (2) and second (3) sets of grinding elements are each pivotally hinged to the respective holders (5, 6) about an axis (R, R') that is substantially parallel to the respective front faces (15) of the grinding elements (2, 3) in said first (2) and second (3) sets of grinding elements.

2. The apparatus of claim 1, wherein each coupling means comprise a ridge (26) with a partially circular sectional profile protruding from the rear face (25) of each said grinding element in a direction away from the respective front face (15) of each said grinding element, with a center of the circle forming said partially circular sectional profile corresponding to said pivot axis (R, R'), and the ridge (26) pivotally received in a groove (27) of corresponding sectional profile and formed in a forward end (28) of the respective holder (5, 6) facing the rear face (25) of the respective grinding element.

3. The apparatus of claim 2, wherein the rear face (25) of each said grinding element (2,3) is formed with two sloping surfaces situated on opposite sides of said partially circular sectional profile of said ridge (26), and with said sloping surfaces sloping away from one another at an obtuse angle (β) defined in a direction perpendicular to said pivot axis (R, R').

4. The apparatus of claim 1, wherein the rear face (21) of each said grinding element (2,3) is supported against a curved or partially circular forward end (20) of the respective holder (5,6) and extending towards the front face (15) of each said grinding element and forming part of said coupling means.

5. The apparatus of claim 4, wherein each said grinding element (2,3) comprises a pair of lateral sides extending rearwardly from the front face (15) to the rear face (25) thereof, and with ends of said lateral sides of each said grinding element curved inwardly towards one another to form a pair of engagement lugs (18) configured to be engaged in recesses (19) respectively formed in side flanks of the respective holder (5, 6) around said circular forward end (20) of each said holder (5, 6), the respective lug (18) and recess (19) in mutual engagement together control pivotal movement of each said grinding element (2,3) with respect to the respective holder (5,6) about said pivot axis (R, R').

6. The apparatus of claim 4, wherein the front face (15) of each said grinding element (2,3) of said first (2) and second (3) sets of grinding elements comprises is an abrasive coated plate member (16).

7. A grinding element (2, 3), for a sharpening apparatus and comprising a holder (5, 6) supporting the grinding element (2, 3), said holder (5,6) movable in opposite directions (B), and a spring (9, 10) biasing said holder (5, 6) in one of the opposite directions (B), the grinding element (2, 3) having a front face (15) and a rear face (25) opposite one another, the rear face (25) comprising coupling means (26, 27) pivotally connecting to the holder (5, 6) about an axis (R, R') that is substantially parallel to the front face (15) of the grinding element (2, 3), wherein said coupling means (26, 27) comprise a ridge (26) which has a partially circular sectional profile protruding away from the rear face (25) and centrally extending along the rear face (25) of the grinding element, with a center of the circle forming said partially circular sectional profile corresponding to said pivot axis (R, R'), the front face (15) of the grinding element (2, 3) is substantially planar, the grinding element (2, 3) also having two lateral sides (23, 24) connecting the front face (15) with the rear face (25), and the rear face (25) including two sloping surfaces situated on opposite sides of said partially circular sectional profile of said ridge (26), and with said sloping surfaces sloping away from one another at an obtuse angle (β) defined in a direction perpendicular to said pivot axis (R, R').

8. A grinding element (2, 3), for a sharpening apparatus and comprising a holder (5, 6) supporting the grinding element (2, 3), said holder (5,6) movable in opposite directions (B), and a spring (9, 10) biasing said holder (5,6) in one of the opposite directions (B), wherein the grinding element (2, 3) has a front face (15) and an opposite rear face (25), the rear face (25) comprising coupling means (26, 27) pivotally connectable to the holder (5, 6) about an axis (R, R') that is substantially parallel to the front face (15) of the grinding element (2, 3), and the grinding element is in the form of a plate member (16) having the front face (15) which is substantially planar and abrasive coated, and having a pair lateral sides of the plate member (16) extending between the front and rear faces (15, 25) being bent back from the front face (15) and inwards towards each other to form engagement lugs (18) of said coupling means (26, 27).

* * * * *